US006779282B2

(12) United States Patent
Gröhninger

(10) Patent No.: US 6,779,282 B2
(45) Date of Patent: Aug. 24, 2004

(54) INSOLE

(76) Inventor: Frank Friedrich Gröhninger, Heinrich-Hertz-Strasse 5, 66450 Oberbexbach (DE)

( * ) Notice: Subject to any disclaimer, the term of this patent is extended or adjusted under 35 U.S.C. 154(b) by 0 days.

(21) Appl. No.: 10/292,741

(22) Filed: Nov. 12, 2002

(65) Prior Publication Data

US 2003/0061738 A1 Apr. 3, 2003

Related U.S. Application Data

(63) Continuation-in-part of application No. 09/887,397, filed on Jun. 22, 2001, now abandoned, and a continuation of application No. PCT/DE99/03403, filed on Oct. 25, 1999.

(51) Int. Cl.[7] ..... A43B 7/20
(52) U.S. Cl. ..... 36/89; 602/27; 2/241
(58) Field of Search ..... 36/89, 10, 55; 602/27, 65; 2/239, 240, 241

(56) References Cited

U.S. PATENT DOCUMENTS

| | | | | | |
|---|---|---|---|---|---|
| 2,080,499 | A | | 5/1937 | Nathansohn | |
| 2,286,495 | A | | 6/1942 | Matteson | |
| 4,008,530 | A | | 2/1977 | Gager | |
| 4,166,460 | A | * | 9/1979 | Applegate | 602/27 |
| 4,211,236 | A | | 7/1980 | Krinsky | |
| 4,665,576 | A | | 5/1987 | Limbach | |
| 4,744,157 | A | | 5/1988 | Dubner | 36/88 |
| 4,993,429 | A | | 2/1991 | Krinsky | |
| 5,067,255 | A | | 11/1991 | Hutcheson | |
| 5,152,081 | A | | 10/1992 | Hallenbeck et al. | 36/28 |
| 5,226,875 | A | | 7/1993 | Johnson | 36/89 |
| 5,366,439 | A | * | 11/1994 | Peters | 602/27 |
| 5,501,659 | A | * | 3/1996 | Morris et al. | 602/27 |
| 5,507,720 | A | * | 4/1996 | Lampropoulos | 602/27 |
| 5,513,450 | A | | 5/1996 | Aviles Palazzo | 36/89 |
| 5,720,715 | A | * | 2/1998 | Eriksson | 602/65 |
| 5,741,222 | A | * | 4/1998 | Fiore | 602/27 |
| 5,775,008 | A | | 7/1998 | Bussell et al. | 36/89 |
| 5,778,563 | A | * | 7/1998 | Ahlbaumer | 36/88 |
| 5,833,640 | A | * | 11/1998 | Vazquez et al. | 602/27 |
| 5,836,903 | A | * | 11/1998 | Peters | 602/27 |

FOREIGN PATENT DOCUMENTS

| | | |
|---|---|---|
| DE | 24 60 034 A | 6/1976 |
| DE | 90 00 041 U1 | 4/1990 |
| DE | 195 40 567 C1 | 2/1997 |
| DE | 298 05 396 U1 | 7/1998 |
| DE | 298 10 518 U1 | 10/1998 |
| EP | 0 060 353 A | 9/1982 |
| EP | 0 434 076 A2 | 6/1991 |
| WO | WO 95/00047 A | 1/1995 |
| WO | WO 98/56272 A | 12/1998 |

* cited by examiner

*Primary Examiner*—M. D. Patterson
(74) *Attorney, Agent, or Firm*—Collard & Roe, P.C.

(57) ABSTRACT

An insole which extends from the toes to the heel includes at least one fluid-filled container; a control unit for enabling a user to increase or reduce an amount of fluid in the container; and a stirrup-shaped device for immobilizing the talocalcaneonavicular joint and for controlling and/or stabilizing the ankle joint. The insole is a prefabricated insole selectable from a range of differently shaped insoles for the various forms of foot prophylaxis and the various shoe sizes. The insole can also be configured in combination with a athletic sock and can be configured as a partial insole. This enables users to adapt the prefabricated insoles suitable for their shoe size and form of foot prophylaxis to their own personal needs.

19 Claims, 5 Drawing Sheets

INSOLE

CROSS-REFERENCES TO RELATED APPLICATIONS

This application is a continuation-in-part of prior filed U.S. application Ser. No. 09/887,397, filed Jun. 22, 2001, now abandoned.

This application is a continuation of prior filed copending PCT International application no. PCT/DE99/03403, filed Oct. 25, 1999.

This application claims the priority of German Patent Application Serial No. 298 22 941.2, filed Dec. 23, 1998, the subject matter of which is incorporated herein by reference.

BACKGROUND OF THE INVENTION

The present invention relates, in general, to an insole for shoes, and more particularly to a shoe insole, which extends from the toes to the heel and includes at least one fluid-filled container. The invention relates further to an athletic sock associated with an insole.

European Pat. No. EP 0 060 353 A 1 describes an insole for use especially by people who have to stand for long periods. The fluid-filled containers serve to transmit load stresses from the foot's support points to large-surface parts of the insole, and simultaneously massage those areas of the sole in contact with them. However, these insoles cannot be adapted to the user's individual needs.

European Pat. No. EP 0 434 076 A2 describes an insole which has transverse profiling running transversely to the longitudinal direction of the shoe, and includes one or more damping elements in the heel region and/or in the forefoot region.

German Pat. No. DE 298 05 396 U1 describes a shoe with an exchangeable insole, with the upper part of the shoe being higher than normal for the size of the shoe so as to make the shoe suitable for the insertion of an exchangeable, relatively thick anatomically shaped insole.

German Pat. No. DE 195 40 567 C1 discloses a shoe with a removable footbed to allow, when necessary, to combine the shoe's footbed with a special orthopedic half insole.

A modular system for an insole is known from German Pat. No. DE 298 10 518 U1, which permits a high degree of flexibility in the manufacturing of customized insoles. However, it is highly unlikely that a layman will be able to take the necessary measurements and assemble the product.

German Pat. No. DE 90 00 041 U1 describes an insole with adjustable and exchangeable support height. The insole, which is known per se, is of firm material combined with an elastic upper layer in which there are hollow, non-connected ribs for insertion of the support element.

U.S. Pat. No. 4,665,576 A describes a ski boot provided with several exchangeable insoles that are beveled in various ways.

International applications WO/9500047 and WO/9856272 disclose insoles which have a container and with which the degree of plantar arch support can be adjusted by varying the pressure in the container.

German Pat. No. DE 24 60 034 A 1 describes a sports shoe with a gas or air cushion sac integrated in the sole. In like manner, U.S. Pat. No. 4,008,530 A describes a shoe with an air cavity integrated in the sole.

For prophylactic purposes and in cases of certain orthopedic indications, it is also known to make footprints, which are used to make customized insoles. These insoles can then be inserted into shoes. However, customizing insoles in this way is relatively tedious and very expensive. With increasing life expectation and an increasing number of minor, wear-induced foot disorders, the importance of foot prophylaxis is becoming ever greater. This applies in particular in cases where stress loads are high, e.g. due to sport. However, such prophylaxis would be unaffordable with conventional procedures.

For ease of the user, an insole as afore-described can also be used in combination or association with an athletic sock, in which case the insole is configured as an orthotic device secured to the athletic sock in either a removable or non-removable manner.

The insole associated with the athletic sock can also be configured to cover less than the entire length of the foot, such that the insole can cover the heel only, or the insole can extend from the heel to the midfoot, or it can be configured to cover the foot from the heel to the toes.

However, a sports shoe, respectively a sports boot, which are too rigid cannot follow the users foot in an anatomically correct way, and thus the athletic sock according to the invention has functions which no other shoe or boot can provide. Furthermore, the shoe provides too much pseudarthrose, which also has the negative factors in skin abrasion, especially at the joints, and crimping of the socks which also produces chafing.

It would therefore be desirable and advantageous to provide an improved low-cost insole which obviates prior art shortcomings and which is suitable for foot prophylaxis and adaptable to the needs of the user.

SUMMARY OF THE INVENTION

According to one aspect of the present invention, an insole extending from toes to heels, includes at least one fluid-filled container; a control unit for enabling a user to increase or reduce an amount of fluid in the container; and a stirrup-shaped device for immobilizing the talocalcaneonavicular joint and for controlling and/or stabilizing the ankle joint.

These measures significantly reduce the risk of supination and pronation, and are thus especially beneficial in the case of sports such as soccer and cross-country running, and also for rehabilitation shoes when the patient has suffered a supination trauma and distortions in the ankle joint area. Immobilizing the talocalcaneonavicular joint in this way is also recommended for sports which heavily stress this joint and the ankle joint, e.g. soccer, American football, rugby, handball, basketball, tennis, etc.

The container can extend over the entire insole, or only over part of it. In the former case, the insole itself can be designed as a container. Since the user is able to vary the hardness of the insole in the area of the container, he/she can adapt the insoles to suit his/her personal needs.

According to another feature of the present invention, the control unit may include a valve. Suitably, the valve is located at a side of the insole.

According to another feature of the present invention, the container may be made of a gel or a foamed plastic. Suitably, the container may be made with a graduation for indicating the amount of fluid in the container. The graduation may include graduation marks running transversely to the longitudinal axis of the insole. The container may suitably disposed in the heel region and/or in the area of the lateral longitudinal arch and/or in the area extending from the fifth metatarsal head to the first metatarsal head.

According to another feature of the present invention, the insole is a prefabricated insole selectable from a range of insoles for different forms of foot prophylaxis and different shoe sizes. Customized insoles are thus only required in case of medical indications, while simple foot prophylaxis and protective therapy for athletes' feet can be undertaken cost efficiently with a modular system of prefabricated insoles designed for specific forms of prophylaxis. This means that for each shoe size, there is a range of insoles available for common types of foot prophylaxis. While in a shoe store, the user can snugly fit insoles into the shoe, test them, and choose the ones that best suit the needs of his/her feet. The user can then adjust the hardness to his/her own needs by adding or withdrawing fluid.

Suitably, the insoles in association with or without an athletic sock may be used for standard foot prophylaxis or for various fallen-arch processes.

It is also conceivable to provide a metatarsal truss pad.

According to another feature of the present invention, a shinbone protector may be integrated with the stirrup-shaped device. It is furthermore useful that the heel region of the insole is raised by an insertion wedge and/or that the area between forefoot and distal tarsus can be designed flatter. This provides relief for the Achilles tendon.

According to another feature of the invention an athletic sock is provided with an insole, which is attached to the athletic sock in a removable or non-removable manner. The insole can, for example, be secured to the athletic sock by means of a suitable glue. Alternatively, the insole/athletic sock combination can be manufactured by a process, wherein the insole material is sprayed onto the athletic sock.

The insole can be configured as an insole for the heel only covering substantially the heel. The athletic sock can also be configured with the insole covering the extent from the heel to the midfoot (metatarsus); or it can be configured as an insole covering the entire foot extending from the heel to the toes. The athletic sock is configured as an athletic sock having a low compression.

According to a further feature of the invention, the insole is configured as an orthotic device extending into a stirrup-type device for stabilizing the foot and the angle of the user. The device can be secured against displacement with a band extending essentially in a horizontal orientation around the leg of the user.

It is also conceivable to provide insoles with different degrees of hardness and/or insoles with zones that differ in hardness.

BRIEF DESCRIPTION OF THE DRAWINGS

Other features and advantages of the present invention will be more readily apparent upon reading the following description of preferred exemplified embodiments of the invention with reference to the accompanying drawing, in which.

DETAILED DESCRIPTION OF PREFERRED EMBODIMENTS

Figure 1A:
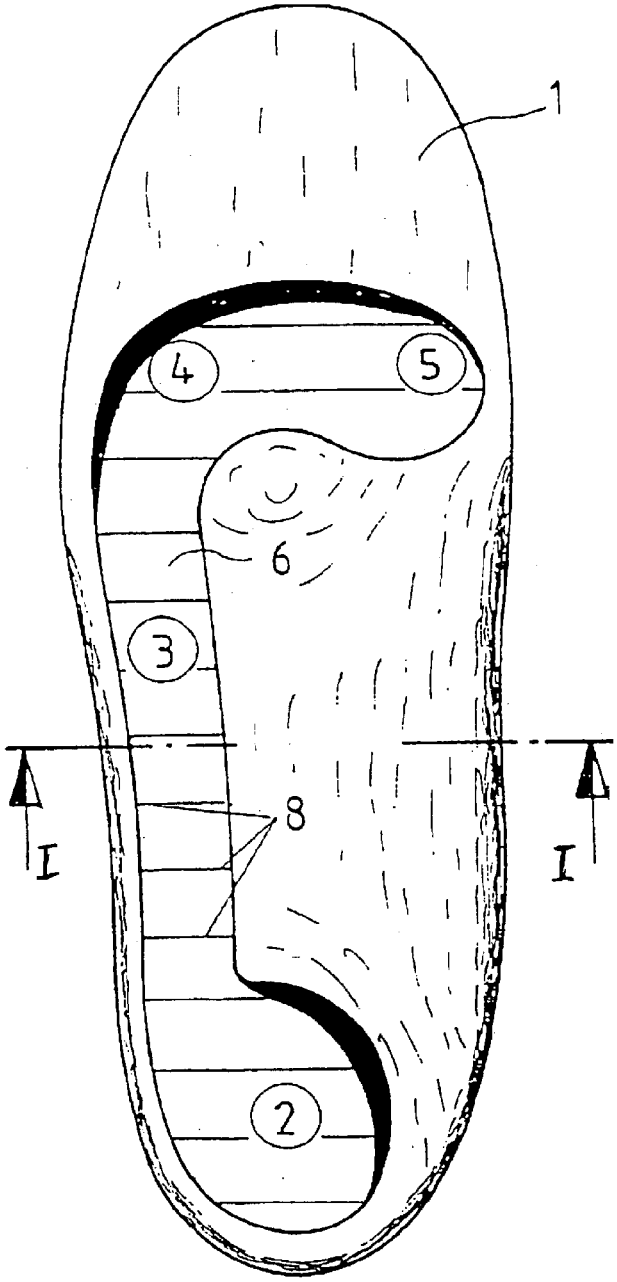
FIG. 1*a* shows a top view of an insole according to the invention.

Throughout all the Figures, same or corresponding elements are generally indicated by same reference numerals.

Insoles are provided for all common shoe sizes and configured for snug fit in the shoe. The insoles accommodate the sole of the foot in a form fit, and intended for cushioning and supporting the foot structures that are exposed to stress. The invention provides for a range of insoles as listed below (using shoe-size 40 as an example):

40 A: Modular insole for standard foot prophylaxis;
Modular insole for diverse degenerative symptoms in the foot structures, the shape of the insole varying to suit the specific symptom;

40B: Fallen plantar arch (early stage) as a result of the old age;

40C: Fallen plantar arch (medium stage) as a result of old age;

40D: Fallen plantar arch (advanced stage) as a result of old age;

40E: Modular insole with stirrup-type stabilization and control of the ankle joint (also in combination with shin-bone protector);

40F: Modular insole for standard foot prophylaxis with heel raising.

Figure 2B:
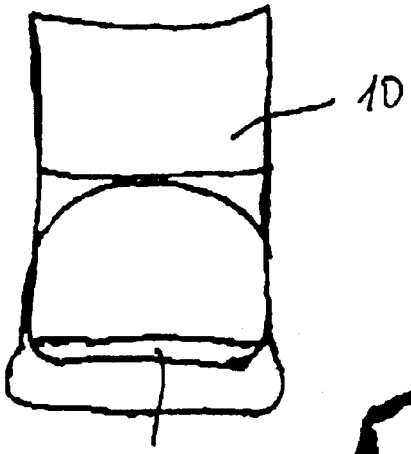
FIG. 2*b* is a rear view of the insole of FIG. 2*a*.
Figure 2A:
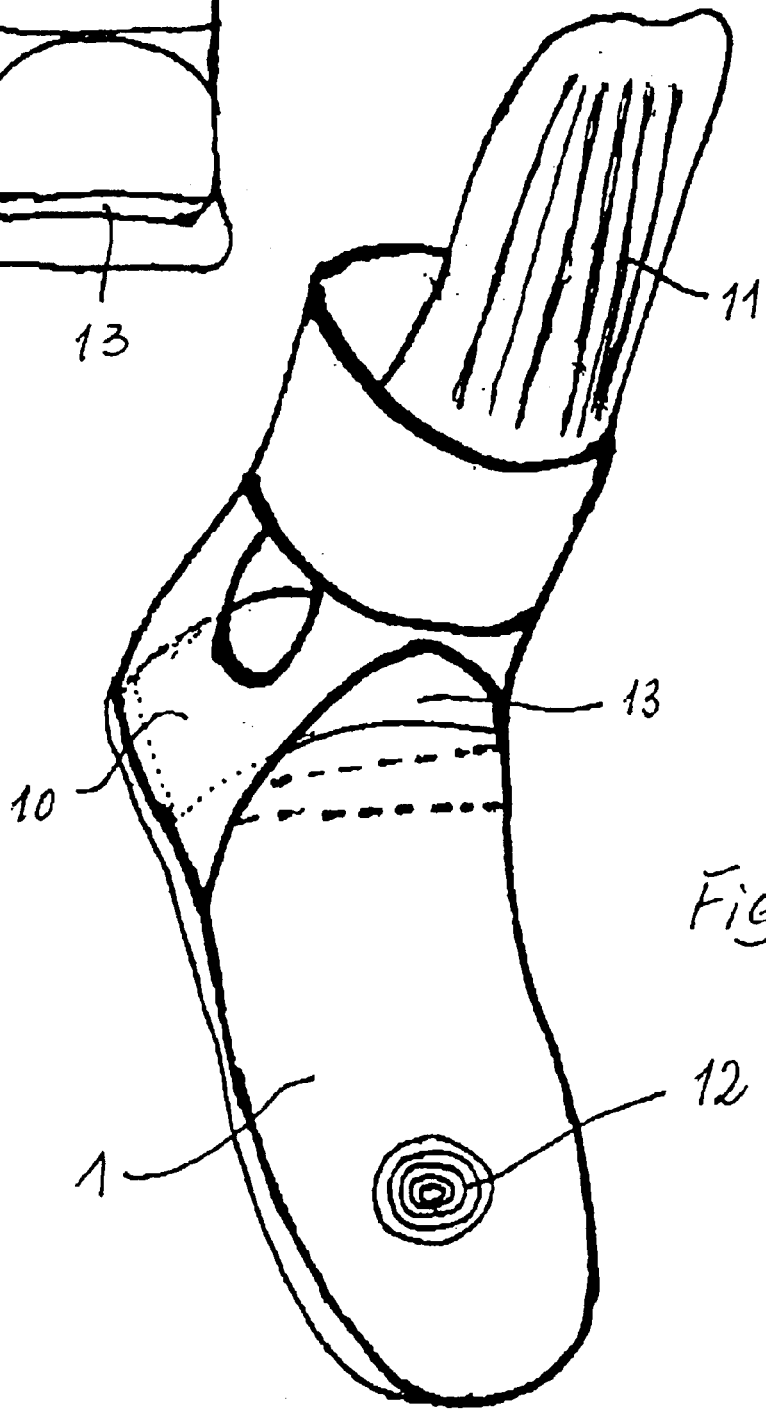
FIG. 2*a* is a top and front perspective illustration of a variation of an insole according to the present invention.

All insole types are provided in different degrees of hardness and with zones that differ in hardness, and all may include a metatarsal truss pad, such as a metatarsal truss pad 12, shown, by way of example, in FIG. 2*a*.

Turning now to the drawing, and in particular to FIG. 1, there is shown a top view of an insole 1 according to the invention. The insole 1 has a container 6 extending from a heel region 2 through a region of the lateral longitudinal arch 3 to a region of the fifth metatarsal head 4 and from there to a region of the first metatarsal head 5. The container 6 is filled with a gaseous (e.g. air) or liquid fluid, preferably a water-based liquid, and is preferably made of a soft material which is impermeable to liquids and gases, adapts to the shape of the foot and has comfortable support properties. Examples as material for the container 6 include, e.g., a gel or a foamed plastic, such as foamed ethylene. Of course, a person skilled in the art is aware of a wide range of gels or foamed plastics and will utilize the type of material which is best adapted to the particular application in which the invention is to be used.

Figure 1B:
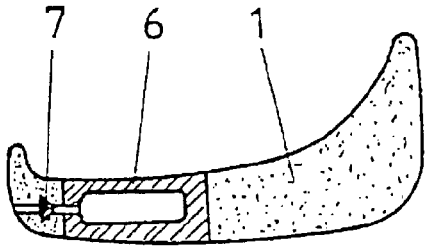
FIG. 1*b* is a sectional view of the insole, taken along the line I—I of FIG. 1*a*.

As shown in FIG. 1*b*, which is a sectional view of the insole, taken along the line I—I of FIG. 1, a valve 7 is provided at a side of the insole 1 for controlling, i.e. increasing or reducing, the amount of fluid in the container 6. This can be done, for example, by means of a syringe, which is insertable into the valve 7, for injection of fluid into the container 6 or withdrawal of fluid from the container 6.

To enable a user to readjust the amount of fluid in the container 6, it is useful to provide a graduation 8, which comprises, for example, graduation marks running transversely to the longitudinal direction of the insole 1. In this way, the user is able to select a suitable insole for a shoe size and for foot prophylaxis, and then to adapt it individually to own personal needs.

As an alternative, the container 6 may also be located only in the heel region or in the region of the lateral longitudinal arch, or from the region of the fifth metatarsal head to the first metatarsal head, or in any combination of these regions.

Turning now to FIG. 2*a*, there is shown a top and front perspective illustration of a variation of the insole 1 according to the present invention. Parts corresponding with those in FIG. 1*a* are denoted by identical reference numerals and not explained again. In this embodiment, provision is made for a stirrup-shaped device 10 for immobilizing the talocalcaneonavicular joint and for controlling and/or stabilizing the ankle joint of a human being. The stirrup-shaped device 10 is thus secured to a rear portion of the insole 1 and projects upwards. Suitably, a shinbone protector 11 is integrated in the stirrup-shaped device 10. In a forward area thereof, the insole 1 includes a metatarsal truss pad 12 for providing an elevation in the metatarsal area whereas in the heel region, the insole 1 is raised by an insertion wedge 13 which is flattened towards the forward part. As an alternative, the area between forefoot and distal tarsus may also be designed flatter. FIG. 2*b* shows a rear view of the insole 1. Of course, the provision of the shin-bone protector 11, metatarsal truss pad 12 and insertion wedge 13 are optional and any combination should be considered within the scope of the present invention.

Figure 3A:
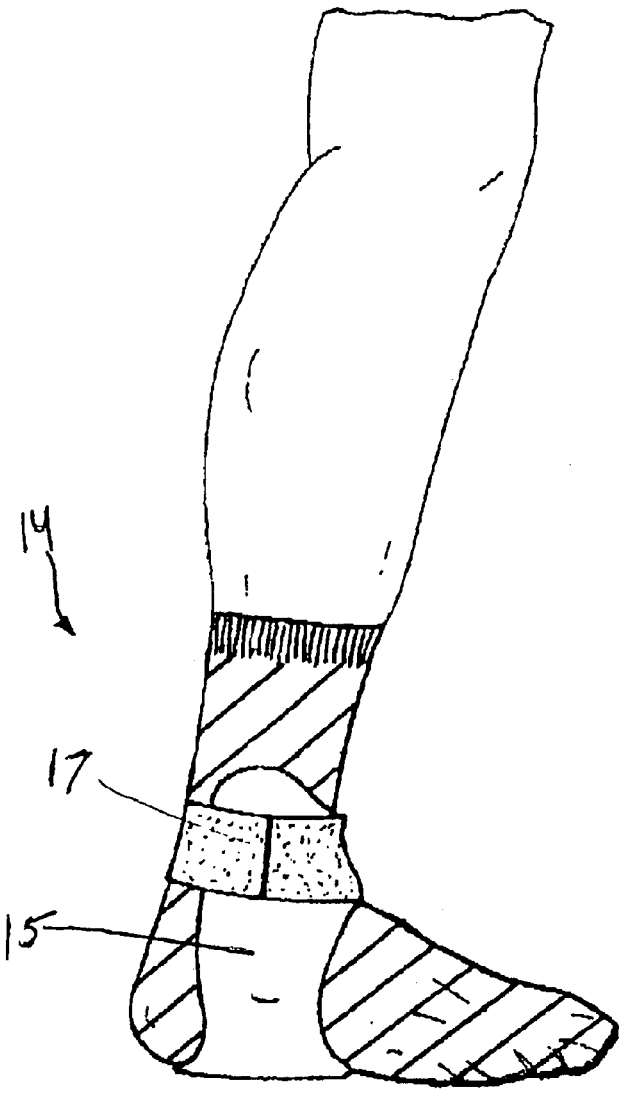
FIG. 3*a* is a lateral side view of a athletic sock showing a stirrup-type device in association with the athletic sock
Figure 3B:
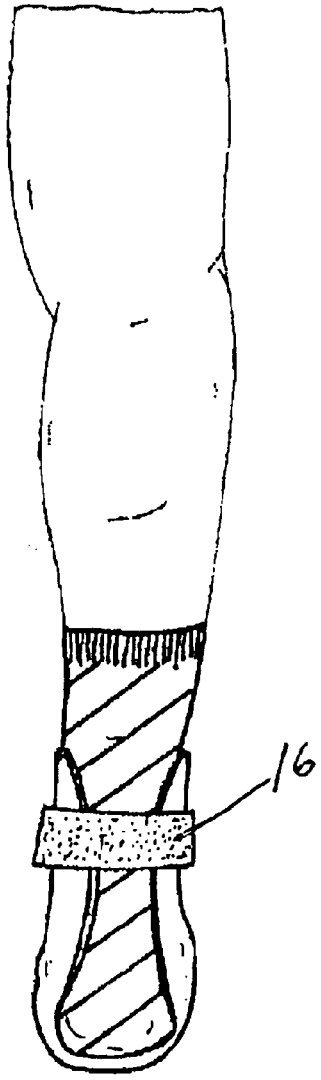
FIG. 3*b* is a rear view of the athletic sock with the stirrup-type device.
Figure 4A:
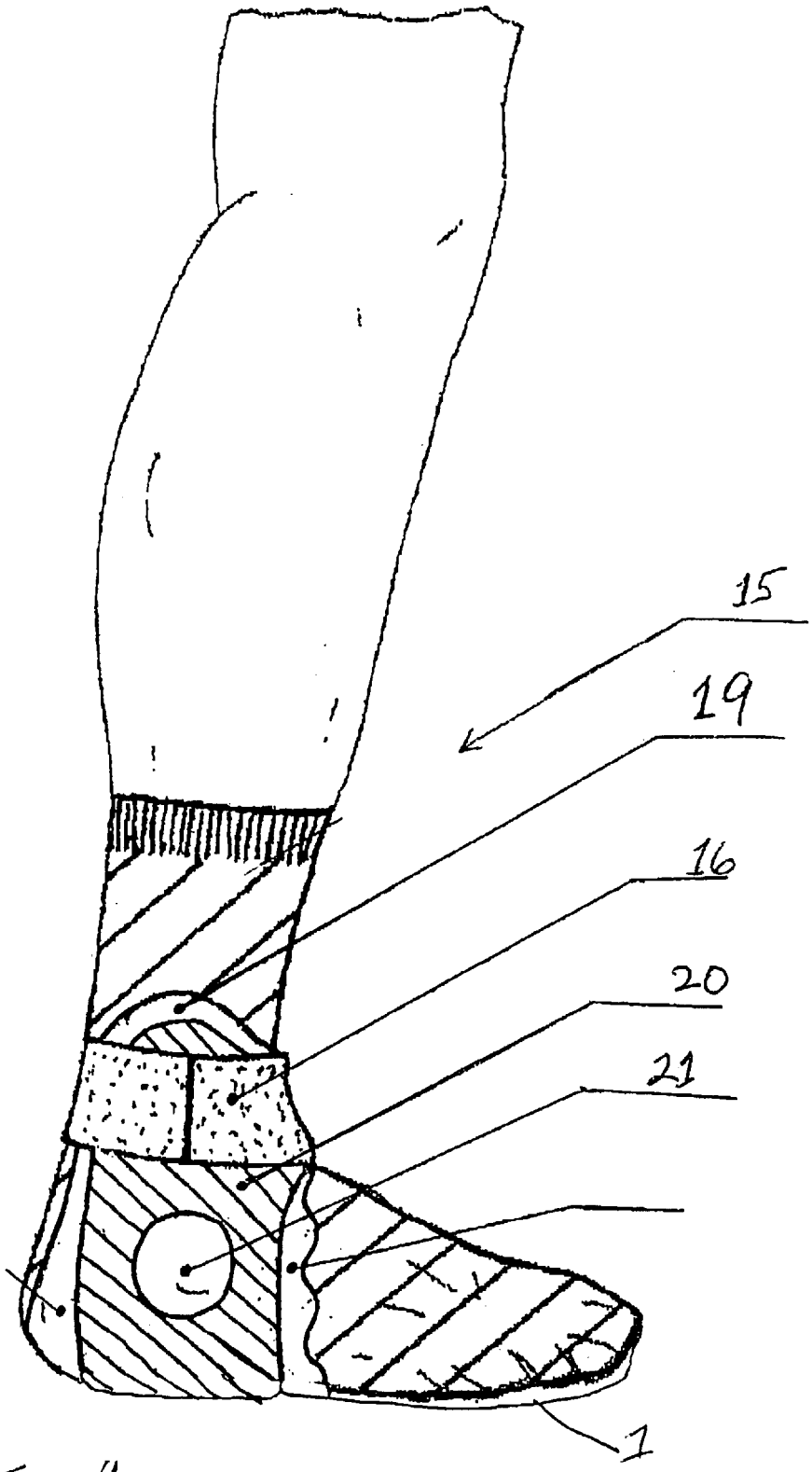
FIG. 4*a* is lateral view of a second embodiment of the atletic sock with a plastic body covering the stirrup-type device.
Figure 4B:
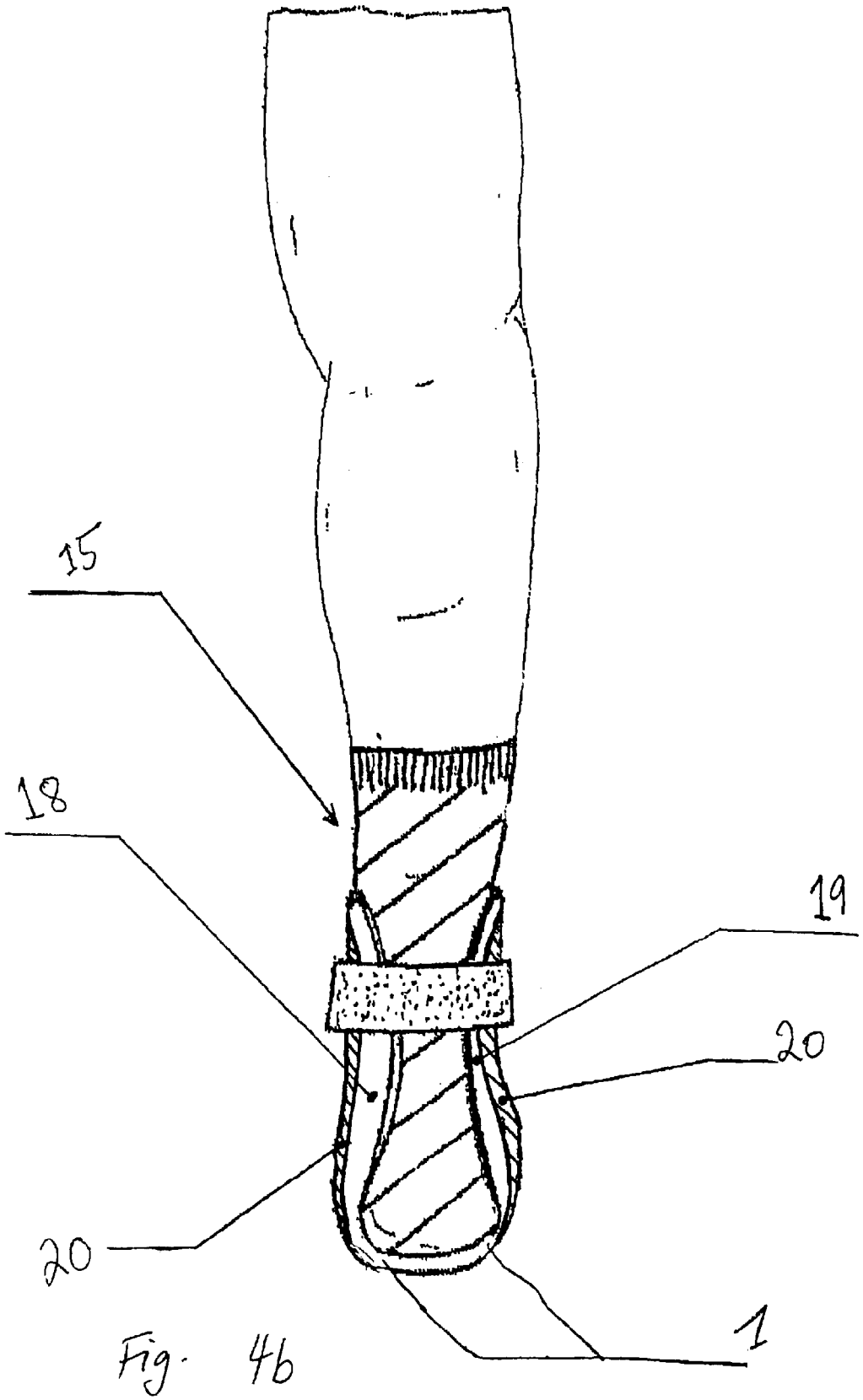
FIG. 4*b* is a rear view of the second embodiment of the athletic sock as seen in 4*a*.

Turning now to FIGS. 3*a* and 3*b*, there is shown a side and rear illustration of an athletic sock generally indicated by 14. The insole 1 shown here extends into the stirrup-type device 15 with two vertical legs configured as entirely unitary piece. The device 15 has a medial leg 18 and a lateral leg 19. FIGS. 3*a–b* and 4*a–b* also show the stirrup-type device 15 secured with a band 16 extending substantially in horizontal direction around the leg of the user. When the stirrup-type device 15 is an integral part of the insole 1, it is formed from the same flexible plastic material as the insole. The front portion of the stirrup-type device 15 is configured as a closed front. However, the front portion may also be configured as a two piece front portion so that two pieces may meet prior to securement with the band 16. The band 16 can extend in a substantially horizontal direction. Alternatively, the band 16 can also be configured as a crossed band. Rearwardly, the stirrup-type device 15 remains open. Generally, the stirrup-type device 15 is from soft plastic. Preferably, the stirrup-type device 15 is constructed in layers, which can be arranged in a sandwich type manner, wherein the inner- and outer layers exhibit varying grades of hardness, respectively softness. For example, the device 15 can be constructed so the layer(s) close to the body of the user can be made from softer material, which can be covered by a relatively stiffer plastic body 20 as seen in FIGS. 4*a–b*. The stiffer plastic body 20 can also be set into the stirrup-type device 15 so as to take up no dimension in addition to that of the stirrup-type device 15. The plastic body optionally has a lateral opening 21 for ease of wear by the user.

Since the container 6 may also be located only in the heel region or in the region of the lateral longitudinal arch, or from the region of the fifth metatarsal head to the first metatarsal head, or in any combination of these regions, the container 6 of the insole 1, also with the stirrup type device 15 for the athletic sock is adjustable to these foot regions. Alternatively, the insole 1 can be configured in various sizes so that it covers the heel only, or the insole 1 can be sized extending from the heel to the midfoot, or from the heel to the toes.

Optionally, the insole 1 of the athletic sock 14 can be configured so it can be filled with a fluid material as described above.

As compared to the insole 1, the combination of insole 1 and the stirrup-type device 15 stabilizes the foot in medial-lateral direction (supination trauma motion) exerting pressure onto the mechano-receptors of the body and thereby activating these. This is known as "proprioception" which leads to autostabilization of the body. Thus, with the combination of the insole 1 and device 15 according to the invention on the one hand, a prophylaxis against supination trauma is realized and on the other hand, the proprioception is raised, which is further enhanced by means of the frictional band 16 disposed in substantial horizontal position. The stirrup-type device 15 can be removably secured to the athletic sock, for example by means of a Velcro®-type fastener 17 or other type of hook and loop fastener. In an alternate manner, the stirrup-type device 15 is secured to the athletic sock in a non-removable manner, for example by being sown to the sock. In another manner, the athletic sock 14 is manufactured so that the plastic insole 1 with the stirrup-type device 15 is sprayed directly onto the sock material to which it bonds. The outer plastic layer 20 can be an integral part of the insole 1 with the stirrup-type device 15 or it can be attached to by other means.

Optionally, a shinbone protector 11 can also be integrated with the stirrup-type device 15; for example the shinbone protector can be attached to the lower end at the front of the stirrup-type device.

While the invention has been illustrated and described as embodied in an insole, it is not intended to be limited to the details shown since various modifications and structural changes may be made without departing in any way from the spirit of the present invention.

What is claimed as new and desired to be protected by Letters Patent is set forth in the appended claims:

1. An athletic sock comprising:

an insole securely fastened to the athletic sock, a flexible stirrup-shaped device attached to the insole and extending from the insole in the form of two side portions of suitable material and interconnected anteriorly for transverse stabilization of an ankle joint, each of said side portions having an opening for passage of an ankle; and a circumferential band extending in horizontal direction perpendicular to the side portions for securely holding the side portions in place for immobilizing a talocalcaneonavicular joint and for controlling and stabilizing the ankle joint of the leg and;

a shin protector secured to the band and extending upwards from an upper region of the stirrup device;

wherein said athletic sock limits a supination trauma motion of a foot when worn by a user.

2. The athletic sock of claim 1, wherein the insole is attached to the athletic sock by means of one of a removable or nonremovable attachment.

3. The athletic sock of claim 2, wherein the insole is attached to the athletic sock by a removable attachment selected from the group consisting of glued-or sewed attachment or by a hook and loop-type fastener.

4. The athletic sock of claim 2, wherein the insole is bonded to the athletic sock by a plastic spray-bonding method.

5. The athletic sock of claim 1, further comprising a plastic layer over each of the two vertical legs of the device.

6. The athletic sock of claim 5, wherein the plastic layer is from a material harder than the material of the legs of the stirrup type device.

7. The athletic sock of claim 1, wherein the plastic layer is Sct integrated into the vertical legs of the stirrup-type device.

8. The athletic sock of claim 1, wherein the insole is of a size selected from the group consisting of covering only the heel portion of the foot, covering the midfoot portion, covering the entire foot.

9. The athletic sock of claim 1, wherein the insole includes at least one fluid-filled compartment container and control means for enabling a user to increase or reduce an amount of fluid in the container.

10. The athletic sock of claim 9, wherein the control means includes a valve.

11. The athletic sock of claim 10, wherein the valve is located at a side of the insole.

12. The athletic sock of the claim 9, wherein the container is made of a material selected from the group consisting of gel and foamed plastic.

13. The athletic sock of claim 9, wherein the container has a graduation for indication of the amount of fluid in the container.

14. The athletic sock of claim 13, wherein the graduation has graduation marks running transversely to a longitudinal axis of the insole.

15. The athletic sock of claim 1, wherein the container is locate at least in a region selected from the group consisting of heel, lateral longitudinal arch, and an area extending from fifth metatarsal head to first metatarsal head.

16. The athletic sock of claim 1, wherein the sock is prefabricated in different forms of foot prophylaxis and different shoe sizes.

17. The athletic sock of claim 1, and further comprising a shinbone protector integrated in the stirrup-shaped device.

18. The athletic sock of claim 1, and further comprising an insertion wedge for elevating a heel region of the insole.

19. The athletic sock of claim 1, wherein an area between forefoot and distal tarsus is flattened as compared to a heel region of the insole.

* * * * *

UNITED STATES PATENT AND TRADEMARK OFFICE

CERTIFICATE OF CORRECTION

PATENT NO. : 6,779,282 B2
DATED : August 24, 2004
INVENTOR(S) : Gröhinger

It is certified that error appears in the above-identified patent and that said Letters Patent is hereby corrected as shown below:

Title page,
Item [30], Foreign Application Priority Data, should read:
-- Dec. 23, 1998 (DE)……..298 22 941.2 --.

Signed and Sealed this

Fourteenth Day of December, 2004

JON W. DUDAS
*Director of the United States Patent and Trademark Office*